US007201307B1

(12) United States Patent
Fleming

(10) Patent No.: US 7,201,307 B1
(45) Date of Patent: Apr. 10, 2007

(54) HIGH SECURITY MAIL BOX

(76) Inventor: Mark J. Fleming, 14 Sunflower Dr., Bohemia, NY (US) 11716

( * ) Notice: Subject to any disclaimer, the term of this patent is extended or adjusted under 35 U.S.C. 154(b) by 0 days.

(21) Appl. No.: 11/388,125

(22) Filed: Mar. 23, 2006

(51) Int. Cl.
*A47G 29/12* (2006.01)

(52) U.S. Cl. ..... 232/17; 232/20; 232/27; 232/45

(58) Field of Classification Search ..... 232/17, 232/45, 29, 16, 20, 21, 24, 27; D99/29–32
See application file for complete search history.

(56) References Cited

U.S. PATENT DOCUMENTS

| | | | | |
|---|---|---|---|---|
| 755,038 | A * | 3/1904 | Palmer | 232/24 |
| 4,333,603 | A * | 6/1982 | Carlson | 232/17 |
| 4,361,271 | A | 11/1982 | Hester et al. | |
| 4,726,512 | A | 2/1988 | White | |
| 5,056,711 | A | 10/1991 | Bush | |
| 5,143,284 | A | 9/1992 | Socarras | |
| 5,597,116 | A * | 1/1997 | Morris | 232/20 |
| 6,318,628 | B1 * | 11/2001 | Pangburn | 232/17 |
| 6,722,561 | B1 * | 4/2004 | Thomas et al. | 232/39 |
| 6,808,108 | B1 | 10/2004 | Turnbow et al. | |
| 7,070,090 | B2 * | 7/2006 | Ranen | 232/45 |
| 2004/0238615 | A1 | 12/2004 | Offenbacher | |
| 2005/0258226 | A1 * | 11/2005 | Kujawa et al. | 232/17 |

* cited by examiner

*Primary Examiner*—William L. Miller
(74) *Attorney, Agent, or Firm*—Richard L. Miller

(57) ABSTRACT

A high security mail box which comprises an elongated housing having a front wall, a rear opening and a chamber therein to receive and store incoming mail items. A facility in the elongated housing, is for depositing the incoming mail items within the chamber by a mail person. An access door is hinged to the rear opening of the elongated housing, wherein the access door will move between an open position and a closed position. A mechanism operatively associated with the access door, is for locking the access door in the closed position. An authorized person can disengage the locking mechanism to move the access door from the closed position to the open position, so that the authorized person can remove the incoming mail items from the chamber of the elongated housing.

12 Claims, 1 Drawing Sheet

HIGH SECURITY MAIL BOX

BACKGROUND OF THE INVENTION

1. Field of the Invention

The present invention relates to a secured mailbox, and more particularly, a high security mailbox.

2. Description of the Prior Art

Numerous innovations for secured mailboxes have been provided in the prior art that will be described. Even though these innovations may be suitable for the specific individual purposes to which they address, however, they differ from the present invention.

A FIRST EXAMPLE, U.S. Pat. No. 4,361,271, Issued on Nov. 30, 1982, to Hester et al. teaches a kit for a traditional rural mail box into which mail is usually delivered through an opening in the front of the box, to convert such a mail box into one having two separate compartments, one of which is secured by a lock and into which mail may be placed through a slot and the other of which is open in the usual way, for reception of newspapers, periodicals and other mail whose contents is not of such value as to require secure delivery.

A SECOND EXAMPLE, U.S. Pat. No. 4,726,512, Issued on Feb. 23, 1988, to White teaches a lock adapted for use within a box, container or fastening wherein the lock makes the box, container or fastening freely openable for a first opening, but locked after once opened and reclosed. The lock shown in a preferred embodiment is adapted to fit within a standard rural mailbox of the type approved for use by the U.S. Postal Service wherein an inner lock box is formed within the standard mailbox by a front hinged plate operable in conjunction with movement of the front door of the mailbox and a curved top releaseable by complete closure of the mailbox door wherein such inner lock box front plate and top remain in the completely spread and open position when the mailbox is first opened (presumably by the mailman) and wherein the inner lock box front plate and top are in the closed and locked position upon the second opening of the mailbox such that a key is required to re-open the inner lock box.

A THIRD EXAMPLE, U.S. Pat. No. 5,056,711, Issued on Oct. 15, 1991, to Bush teaches an improved mailbox that allows the recipient of mail to view from a distance the incoming mail chamber and determine if there is mail to pick up. In addition, the mailbox comes with a lockable incoming chamber and a protection flange that keeps out the hands of those that may tamper with the mail.

A FOURTH EXAMPLE, U.S. Pat. No. 5,143,284, Issued on Sep. 1, 1992, to Socarras teaches a security mailbox, to be used to securely and inconspicuously hold incoming mail while providing an accessible means for a mailman to pick up outgoing mail. The mailbox includes a readily accessible lower compartment and a locked upper compartment, accessible for mail delivery by a flapped opening and having a lockable back door, which are separated and defined by an angled dividing wall that remains substantially hidden when the lower compartment is accessed.

A FIFTH EXAMPLE, U.S. Pat. No. 6,808,108 B1, Issued on Oct. 26, 2004, to Turnbow et al. teaches an improved mailbox which includes a security subassembly. The security subassembly includes an elongated sleeve which is fixed into position relative to a mailbox. It further includes a security door which is locked into position relative to the elongated sleeve. A mail slot is provided in the security door which allows for a mail carrier to deposit mail within the central cavity of the mailbox. A locking mechanism is provided to allow the security door to be moved between a normally closed condition and an open condition to allow the authorized user to remove mail from the central cavity of the mailbox.

A SIXTH EXAMPLE, U.S. Patent Office Document No. 2004/0238615 A1, Published on Dec. 2, 2004, to Offenbacher teaches a device for placement within a rural style mail box to provide a secure repository for items of mail delivered. A forward positioned, secure chamber for the storage of delivered items is defined by a first insert having a top surface, and two supporting side surfaces. A separate assembly placed rear of the first insert includes an opposing slide assembly defined by a smooth surface with an inclination against the rear of the mail box and sloped downwardly toward the secure storage area. Coming into contact with the slide assembly, mail is thus redirected to the secure area. In an alternative embodiment, a unitary mailbox is described which includes an inclined compression delivery channel for delivery of mail to a secure chamber beneath, the compression channel at the same time presenting an obstacle to unauthorized access.

It is apparent now that numerous innovations for secured mailboxes have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a high security mailbox that avoids the disadvantages of the prior art.

ANOTHER OBJECT of the present invention is to provide a high security mailbox that is simple and inexpensive to manufacture.

STILL ANOTHER OBJECT of the present invention is to provide a high security mailbox that is simple to use.

BRIEFLY STATED, STILL YET ANOTHER OBJECT of the present invention is to provide a high security mailbox which comprises an elongated housing having a front wall, a rear opening and a chamber therein to receive and store incoming mail items. A facility in the elongated housing, is for depositing the incoming mail items within the chamber by a mail person. An access door is hinged to the rear opening of the elongated housing, wherein the access door will move between an open position and a closed position. A mechanism operatively associated with the access door, is for locking the access door in the closed position. An authorized person can disengage the locking mechanism to move the access door from the closed position to the open position, so that the authorized person can remove the incoming mail items from the chamber of the elongated housing.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALLING OF REFERENCE NUMERALS UTILIZED IN THE DRAWING

Figure 1:
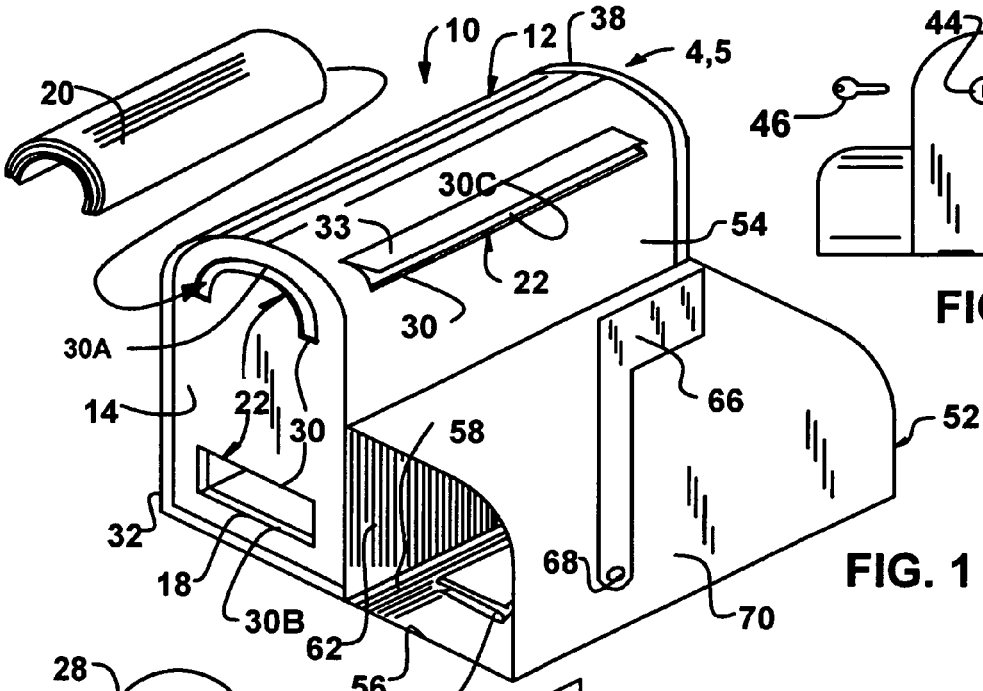
FIG. 1 is a diagrammatic front perspective view of the present invention showing an incoming mail item about to be inserted into a curved slot in a front wall of an elongated housing.

| | |
|---|---|
| 10 | high security mailbox |
| 12 | elongated housing of high security mailbox 10 |
| 14 | front wall of elongated housing 12 |
| 16 | rear opening in elongated housing 12 |
| 18 | chamber in elongated housing 12 |
| 20 | incoming mail item |
| 22 | depositing facility of high security mailbox 10 |
| 24 | access door of high security mailbox 10 |
| 26 | hinge of access door 24 |
| 28 | locking mechanism of high security mailbox 10 |
| 30 | slot in elongated housing 12 |
| 30A | curved slot formed through the front wall 14 |
| 30B | straight slot formed through the front wall 14 |
| 30C | long slot formed through one side of the elongated housing 12 |
| 32 | rain shield on front wall 14 |
| 33 | long rain shield on elongated housing 12 |
| 34 | keypad for locking mechanism 28 |
| 36 | finger grip in access door 24 |
| 38 | protective door of high security mailbox 10 |
| 40 | inner gasket of protective door 38 |
| 42 | hinge of protective door 38 |
| 44 | cylinder lock for locking mechanism 28 |
| 46 | key for cylinder lock 44 |
| 48 | padlock for locking mechanism 28 |
| 50 | key for padlock 48 |
| 52 | elongated structure of high security mailbox 10 |
| 54 | rear wall of elongated structure 52 |
| 56 | front opening of elongated structure 52 |
| 58 | compartment in elongated structure 52 |
| 60 | outgoing mail item |
| 62 | one side of elongated structure 52 |
| 64 | one side of elongated housing 12 |
| 66 | signal flag for elongated structure 52 |
| 68 | hinge of signal flag 66 |
| 70 | free side of elongated structure 52 |

DETAILED DESCRIPTION OF THE PREFERRED EMBODIMENT

Figure 2:
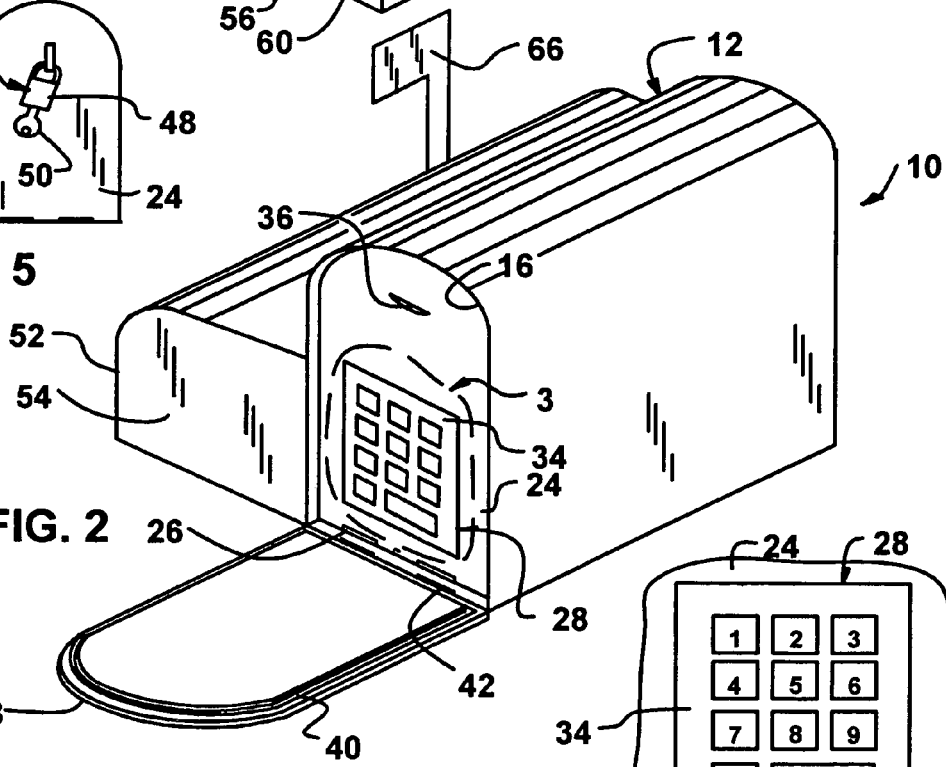
FIG. 2 is a diagrammatic rear perspective view showing a first embodiment of the present invention with a protective door in an open position, so that an authorized person can enter a code on a keypad, to open an access door on the elongated housing.

Referring now to the figures, in which like numerals indicate like parts, and particularly to FIGS. 1 and 2, which are a diagrammatic front perspective view of the present invention, showing an incoming mail item about to be inserted into a curved slot in a front wall of an elongated housing and a diagrammatic rear perspective view, showing a first embodiment of the present invention with a protective door in an open position, so that an authorized person can enter a code on a keypad, to open an access door on the elongated housing, and as such, will be discussed with reference thereto.

The present invention is a high security mailbox 10 which comprises an elongated housing 12 having a front wall 14, a rear opening 16 and a chamber 18 therein to receive and store incoming mail items 20. A facility 22 is for depositing the incoming mail items 20 within the chamber 18 by a mail person. An access door 24 is hinged at 26 to the rear opening 16 of the elongated housing 12, wherein the access door 24 will move between an open position and a closed position. A mechanism 28, operatively associated with the access door 24, is for locking the access door 24 in the closed position. An authorized person can disengage the locking mechanism 28 to move the access door 24 from the closed position to the open position, so that the authorized person can remove the incoming mail items 20 from the chamber 18 of the elongated housing 12.

The depositing facility 22 includes a plurality of slots 30 through the elongated housing 12, wherein the incoming mail items 20 can be inserted through the slots 30 and into the chamber 18. The front wall 14 of the elongated housing 12 has a rain shield 32 thereabout. One of the slots 30A is curved and formed through the front wall 14. The curved slot 30A is particularly useful for inserting large items such as magazines without having to fold them. One of the slots 30B is straight and formed through the front wall 14. One of the slots 30C is long and formed through one side of the elongated housing 12. A long rain shield 33 is secured to the elongated housing 12 over the long slot 30.

Figure 3:
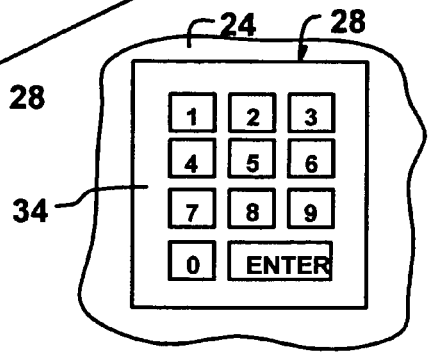
FIG. 3 is a diagrammatic enlarged rear elevational view of an area indicated by arrow 3 in FIG. 2, showing the keypad in greater detail.

FIG. 3 is a diagrammatic enlarged rear elevational view of an area indicated by arrow 3 in FIG. 2, showing the keypad in greater detail, and as such, will be discussed with reference thereto. The locking mechanism 28 consists of a keypad 34 in the access door 24. The authorized person can use the keypad 34 to allow the access door 24 to move into the open position.

The access door 24 is recessed within the rear opening 16 and includes a finger grip 36 to help the authorized person move the access door 24 into the open position. The high security mailbox 10 further includes a protective door 38, having an inner gasket 40. The protective door 38 is hinged at 42 to the rear opening 16 of the elongated housing 12. The protective door 38 can move between an open position to expose the keypad 34 and a closed position in cover the keypad 34.

Figure 4:
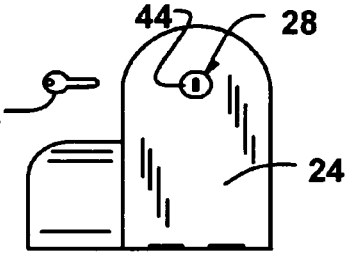
FIG. 4 is a diagrammatic rear elevational view taken in the direction of arrow 4 in FIG. 1, showing a second embodiment, in which a key operated cylinder lock is utilized to lock the access door.

FIG. 4 is a diagrammatic rear elevational view taken in the direction of arrow 4 in FIG. 1, showing a second embodiment, in which a key operated cylinder lock is utilized to lock the access door, and as such, will be discussed with reference thereto. The locking mechanism 28 is a cylinder lock 44 in the access door 24. The authorized person can use a key 46 to open the cylinder lock 44 to allow the access door 24 to move into the open position.

Figure 5:
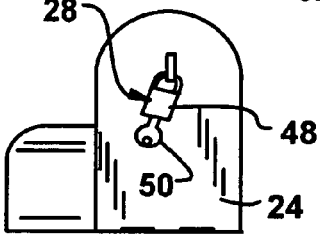
FIG. 5 is a diagrammatic rear elevational view taken in the direction of arrow 5 in FIG. 1, showing a third embodiment, in which a key operated padlock is utilized to lock the access door.

FIG. 5 is a diagrammatic rear elevational view taken in the direction of arrow 5 in FIG. 1, showing a third embodiment, in which a key operated padlock is utilized to lock the access door, and as such, will be discussed with reference thereto. The locking mechanism 28 is a padlock 48 in the access door 24. The authorized person can use a key 50 to open the padlock 48, and allow the access door 24 to move into the open position.

As best seen in FIGS. 1 and 2, the high security mailbox 10 further contains an elongated structure 52 having a rear wall 54, a front opening 56 and a compartment 58 therein to receive outgoing mail items 60 placed through the front opening 56 by the authorized person. The outgoing mail items 60 can be picked up from the compartment 58 by the mail person. One side 62 of the elongated structure 52 is secured to one side 64 of the elongated housing 12. A signal flag 66 is hinged at 68 onto a free side 70 of the elongated structure. The signal flag 66 is movable between a substantially horizontal position to a vertical position, so that the mail person will know that the outgoing mail items 60 are in the elongated structure 52.

It will be understood that each of the elements described above, or two or more together, may also find a useful application in other types of constructions differing from the types described above.

While the invention has been illustrated and described as embodiments of a high security mailbox, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A high security mailbox which comprises:

a) an elongated housing having a front wall, a rear opening and a chamber therein to receive and store incoming mail items;

b) means, in said elongated housing, for depositing the incoming mail items within said chamber by a mail person;

c) an access door hinged to said rear opening of said elongated housing, wherein said access door will move between an open position and a closed position;

d) means, operatively associated with said access door, for locking said access door in the closed position, wherein an authorized person can disengage said locking means to move said access door from the closed position to the open position, so that the authorized person can remove the incoming mail items from said chamber of said elongated housing; and e) wherein said depositing means comprises a plurality of slots through said elongated housing, wherein the incoming mail items can be inserted through said slots and into said chamber, one of said slots being continuously curved and formed through said front wall, and one of said slots being straight and formed through said front wall.

2. The high security mailbox as recited in claim 1, further comprising:

a) said front wall of said elongated housing having a rain shield thereabout.

3. The high security mailbox as recited in claim 1, further comprising:

a) one of said slots being long and formed through one side of said elongated housing; and b) a long rain shield secured to said elongated housing over said long slot.

4. The high security mailbox as recited in claim 1, wherein said locking means comprises a keypad in said access door, wherein the authorized person can use said keypad to allow said access door to move into the open position.

5. The high security mailbox as recited in claim 4, wherein said access door is recessed within said rear opening and comprises a finger grip to help the authorized person move said access door into the open position.

6. The high security mailbox as recited in claim 5, further comprising a protective door having an inner gasket, said protective door is hinged to said rear opening of said elongated housing, wherein said protective door can move between an open position to expose said keypad and a closed position to cover said keypad.

7. The high security mailbox as recited in claim 1, wherein said locking means comprises a cylinder lock in said access door, wherein the authorized person can use a key to open said cylinder lock and allow said access door to move into the open position.

8. The high security mailbox as recited in claim 1, wherein said locking means comprises a padlock in said access door, wherein the authorized person can use a key to open said padlock and allow said access door to move into the open position.

9. The high security mailbox as recited in claim 1, further comprising:

a) an elongated structure having a rear wall, a front opening and a compartment therein to receive outgoing mail items placed through said front opening by the authorized person, wherein the outgoing mail items can be picked up from said compartment by the mail person; and b) means for securing one side of said elongated structure to one side of said elongated housing.

10. The high security mailbox as recited in claim 9, further comprising a signal flag hinged onto a free side of said elongated structure, wherein said signal flag is movable between a substantially horizontal position to a vertical position, so that the mail person will know that the outgoing mail items are in said elongated structure.

11. A high security mailbox which comprises:

a) an elongated housing having a front wall, a rear opening and a chamber therein to receive and store incoming mail items;

b) means, in said elongated housing, for depositing the incoming mail items within said chamber by a mail person;

c) an access door hinged to said rear opening of said elongated housing, wherein said access door will move between an open position and a closed position;

d) means, operatively associated with said access door, for locking said access door in the closed position, wherein an authorized person can disengage said locking means to move said access door from the closed position to the open position, so that the authorized person can remove the incoming mail items from said chamber of said elongated housing, wherein said depositing means comprises a plurality of slots through said elongated housing, wherein the incoming mail items can be inserted through said slots and into said chamber;

e) said front wall of said elongated housing having a rain shield thereabout;

f) one of said slots being curved and formed through said front wall;

g) one of said slots being straight and formed through said front wall;

h) one of said slots being long and formed through one side of said elongated housing;

i) a long rain shield secured to said elongated housing over said long slot, wherein said locking means comprises a keypad in said access door, wherein the authorized person can use said keypad to allow said access door to move into the open position, wherein said access door is recessed within said rear opening and comprises a finger grip to help the authorized person move said access door into the open position, further comprising a protective door having an inner gasket, said protective door is hinged to said rear opening of said elongated housing, wherein said protective door can move between an open position to expose said keypad and a closed position to cover said keypad, further comprising:

j) an elongated structure having a rear wall, a front opening and a compartment therein to receive outgoing mail items placed through said front opening by the authorized person, wherein the outgoing mail items can be picked up from said compartment by the mail person; and k) means for securing one side of said elongated structure to one side of said elongated housing, further comprising a signal flag hinged onto a free side of said elongated structure, wherein said signal flag is movable between a substantially horizontal position to a vertical position, so that the mail person will know that the outgoing mail items are in said elongated structure.

12. A high security mailbox which comprises:

a) an elongated housing having a front wall, a rear opening and a chamber therein to receive and store incoming mail items;

b) means, in said elongated housing, for depositing the incoming mail items within said chamber by a mail person;

c) an access door hinged to said rear opening of said elongated housing, wherein said access door will move between an open position and a closed position;

d) means, operatively associated with said access door, for locking said access door in the closed position, wherein an authorized person can disengage said locking means to move said access door from the closed position to the open position, so that the authorized person can remove the incoming mail items from said chamber of said elongated housing, wherein said depositing means comprises a plurality of slots through said elongated housing, wherein the incoming mail items can be inserted through said slots and into said chamber;

e) said front wall of said elongated housing having a rain shield thereabout;

f) one of said slots being curved and formed through said front wall;

g) one of said slots being straight and formed through said front wall;

h) one of said slots being long and formed through one side of said elongated housing;

i) a long rain shield secured to said elongated housing over said long slot, wherein said locking means comprises a cylinder lock in said access door, wherein the authorized person can use said cylinder lock to allow said access door to move into the open position, further comprising a protective door having an inner gasket, said protective door is hinged to said rear opening of said elongated housing, wherein said protective door can move between an open position to expose said keypad and a closed position to cover said cylinder lock;

j) an elongated structure having a rear wall, a front opening and a compartment therein to receive outgoing mail items placed through said front opening by the authorized person, wherein the outgoing mail items can be picked up from said compartment by the mail person; and k) means for securing one side of said elongated structure to one side of said elongated housing, further comprising a signal flag hinged onto a free side of said elongated structure, wherein said signal flag is movable between a substantially horizontal position to a vertical position, so that the mail person will know that the outgoing mail items are in said elongated structure.

* * * * *